US006948876B2

(12) United States Patent
De Laforcade

(10) Patent No.: US 6,948,876 B2
(45) Date of Patent: Sep. 27, 2005

(54) ROLL-ON TYPE APPLICATOR DEVICE

(75) Inventor: Vincent De Laforcade, Rambouillet (FR)

(73) Assignee: L'Oreal (FR)

( * ) Notice: Subject to any disclaimer, the term of this patent is extended or adjusted under 35 U.S.C. 154(b) by 27 days.

(21) Appl. No.: 10/435,774

(22) Filed: May 12, 2003

(65) Prior Publication Data

US 2004/0033102 A1 Feb. 19, 2004

Related U.S. Application Data

(60) Provisional application No. 60/381,779, filed on May 21, 2002, provisional application No. 60/381,799, filed on May 21, 2002, and provisional application No. 60/381,804, filed on May 21, 2002.

(30) Foreign Application Priority Data

May 13, 2002 (FR) ..... 02 05852
May 13, 2002 (FR) ..... 02 05853
May 13, 2002 (FR) ..... 02 05851

(51) Int. Cl.[7] ..... B43M 11/02; B43M 11/06

(52) U.S. Cl. ..... 401/220; 401/219; 401/183; 401/186

(58) Field of Search ..... 401/183–186, 401/208, 218–220

(56) References Cited

U.S. PATENT DOCUMENTS

| | | | | |
|---|---|---|---|---|
| 1,476,523 A | | 12/1923 | Kerr | |
| 1,538,170 A | | 5/1925 | Cramp | |
| 2,732,575 A | * | 1/1956 | Faust | 401/220 |
| 3,090,987 A | | 5/1963 | Ruekberg | |
| 3,284,839 A | * | 11/1966 | Cook | 401/183 |
| 4,002,411 A | | 1/1977 | Harbauer | |
| 4,359,292 A | * | 11/1982 | Thompson et al. | 401/215 |
| 5,116,156 A | * | 5/1992 | Landi | 401/208 |
| 5,248,213 A | | 9/1993 | Seager et al. | |
| 5,897,267 A | | 4/1999 | Poolman et al. | |

FOREIGN PATENT DOCUMENTS

| | | |
|---|---|---|
| CA | 1207278 | 7/1986 |
| DE | 1141054 | 12/1962 |
| DE | 84 20 113 | 4/1985 |
| DE | 40 30 334 C1 | 4/1992 |
| EP | 0709039 A1 | 5/1996 |
| FR | 1206002 | 2/1960 |
| GB | 1023517 A1 | 3/1966 |

* cited by examiner

*Primary Examiner*—David J. Walczak
(74) *Attorney, Agent, or Firm*—Lerner, David, Littenberg, Krumholz & Mentlik, LLP

(57) ABSTRACT

A device for housing and applying liquid product, the device having an application element with an axis X, a housing partially surrounding the application element, the housing adapted to permit the application element to rotate about axis X, and a container adapted to house a liquid product, the container having a first opening in fluid communication with the housing. The housing having a first position in which the housing moves the application element against the first opening to seal the first opening and a second position in which the housing moves the application element away from the first opening to permit liquid product to flow therefrom. The axis X may intercept a plane containing the first opening. A plunger tube may be placed in fluid communication with the first opening and extend into the container such that liquid fluid may pass therethrough in responses to pressure exerted on the container.

43 Claims, 5 Drawing Sheets

ROLL-ON TYPE APPLICATOR DEVICE

This application claims benefit of 60/381,779, filed May 21, 2002 and claims benefit of 60/381,804, filed May 21, 2002, and claims benefit of 60/381,799, filed May 21, 2002.

The present invention relates to a packaging and applicator structure for a product, in particular a cosmetic product, using an applicator structure of the roll-on type. The invention is particularly suitable to the packaging and application of bodily hygiene products, in particular a deodorant.

Packaging and application devices with a "roll-on" type applicator structure comprise a ball, usually spherical, mounted in free rotation on itself in a housing of corresponding shape, on the top of a container containing the product to be applied. The housing has a first opening for establishing communication between a first part of the ball surface and the product contained in the container, and a second opening through which a second part of the ball surface emerges to the outside.

On application, after removing the cap, the consumer turns the container upside down such that under gravity the product is brought into contact with the first part of the ball surface.

By engaging the second part of the ball surface with the surface to be treated, and by an adequate movement of the device in relation to said surface, the ball is driven in rotation on itself so that the first part of the said ball lies opposite the second opening, thus transferring the product to the surface to be treated.

Generally, the container is produced by blow-moulding of a material such as rigid polypropylene, acrylobutadiene styrene (ABS) or a high density polyethylene. The applicator ball for example can be made of polyethylene.

Typically, these devices are fitted with a removable cap which, when resting on the ball, forces the latter into a tight contact with an edge delimiting the first opening so as to achieve a certain seal, thus interrupting the liquid communication between the container and the housing containing the applicator ball.

Such devices using a spherical ball are described in particular in patents U.S. Pat. No. 4,002,411, DE-A-1 141 054, U.S. Pat. No. 5,897,267, U.S. Pat. No. 3,090,987, FR-A-1 206 002, CA-A-1 207 278 or U.S. Pat. No. 1,476, 523.

In practice, it has been found that it may be desirable to have a device of the roll-on type where the application element is not spherical but for example elongated. Such a non-spherical form could be desired in particular in order to allow a new aesthetic or as a function of the body area to which the product is to be applied, in order to increase the application surface.

Document GB-1,023,517 describes an application element mounted on a flexible reservoir, this application element being cylindrical in form and rotating about a rotation axis parallel to an opening plane ensuring communication between the reservoir and the housing holding the application element.

Document EP-A-0 709 039 describes a device in which the application element is ovoid in shape. Inside a housing of corresponding shape, the application element is free to rotate about an axis parallel to an opening plane ensuring communication between the container and the housing.

A major drawback of such a configuration is that the seal at the application element, in particular during transport or storage of the device, is one of the most difficult to achieve mainly because of the shape of the said application element and its orientation in relation to the opening arranged between the container and the housing holding the application element.

In fact, because of the profile of the part of the ovoid surface of the application element facing the opening allowing communication between the container and the housing containing the application element, which opening is delimited by a flat edge, said surface part cannot be applied uniformly to said flat edge. Therefore, a seal cannot be obtained satisfactorily on closure.

Thus, in a first embodiment proposed by this document, in the storage position the closure between the container and the said housing is ensured by a skirt part formed by the support of the application element and able selectively to come into a sealed engagement inside an axial shaft formed by an intermediate part mounted on the container.

In particular, due to production tolerances of the elements involved in the closure, the seal obtained can be more insufficient in particular after several uses.

According to other design modes, closure of the said opening is obtained by the selective placing in opposition of a first opening formed by the support of the application element and a second opening formed by a part mounted in the neck of the container.

Because of the number of parts constituting the device, its cost price is high. It is therefore incompatible with the economic imperatives of certain distribution circuits for cosmetics, such as large scale distribution.

Document U.S. Pat. No. 5,248,213 discloses a cover to be mounted on the application element, the cover comprising an elastically deformable surface to be applied to the application element to seal the second opening. But this cover is a separate part on the application and packaging device.

Finally—and this also applies to devices with a spherical applicator such as those described above—a problem arises in the actions required by the contact mechanism of the ball with the product contained in the container. In fact, this contact takes place essentially under the force of gravity in response to the turning of the device into its upside down position, which for application of a deodorant to the underarms, can only be done before application. The action therefore requires great care. Also, the viscosity of the product must be very low.

It is therefore one of the objects of the invention to produce a roll-on type application and packaging device which resolves all or part of the problems discussed above in relation to certain conventional systems.

The term "roll-on type applicator structure" means a structure comprising an application element with an application surface revolving around at least one axis, said application element being mounted so as to deposit the product loaded on its application surface by its rotation on itself, in response to a friction movement of said application surface relative to the surface on which the product is to be deposited.

In particular, an object of the invention is to produce such a device in which the seal on closure is both improved and the design simplified.

A further object of the invention is to produce a roll-on type applicator device which is easier to handle in application, in particular for placing the application element in contact with the product to be applied.

A further object of the invention is to produce a device which is of original appearance, simple to use and economic to produce.

Further objects will become apparent in the detailed description which follows.

According to the invention, these objects are achieved by producing a device for packaging and application of a product, in particular a cosmetic product, the device comprising a container containing the product and fitted with an applicator structure comprising:

i) a support delimiting a housing;

ii) a non-spherical application element arranged inside the housing, the surface of which rotates about an axis X; characterised in that this applicator structure comprises iii) means (20) to adapt it from a first configuration in which part of the application element closes in a sealed manner a first opening formed between the container and the housing, to a second configuration in which the housing communicates with the container via said first opening and in which the application element rotates freely about said axis X such that part of the said surface of revolution, after coming into contact with the product, can be brought via a second opening delimited by the housing into engagement with a surface onto which the product is to be applied.

Thus, despite the non-spherical shape of the application element, the latter is configured and mounted so that it can itself tightly seal the said first opening. Therefore no complex, costly and unreliable auxiliary mechanisms are required as described in patent application EP-A-0 709 039 mentioned above. Also, as a result, the cost price is advantageous and use of the device, in particular its transfer from the usage position to the storage position and vice versa, is easy.

Advantageously, said sealing portion is centred on axis X and, perpendicular to a plane of the first opening, has at least one section of circular form.

Further advantageously, said sealing part of the application element consists of a part of a sphere which comes into engagement with an edge, preferably flat, delimiting said first opening and thus forming the seal all around the said opening.

This configuration offers the advantage of being able to incline axis X relative to the axis of the first opening, generally parallel to a longitudinal axis of the container. This incline improves greatly the handling on application. Also, the level of seal obtained remains approximately the same over the period of use. Finally, the system easily adapts to great tolerances in particular because of the adjustment achieved by the engagement of part of a spherical surface with a flat edge.

According to a preferred embodiment said axis X intercepts a centre plane containing said first opening. This characteristic in the case of a non-spherical application element greatly facilitates the design of the device such that closure of the said opening is ensured directly by part of the application element and not by an auxiliary structure, carried in particular by the application element support as described in patent application EP-A-0 709 039.

Therefore, the cost price is advantageous and use of the device, in particular its transfer from the usage position to the storage position and vice versa, is easy.

Said axis X can form an angle between 45° and 80° with said plane. This interval is considered to constitute an optimum range in relation to comfort of use, in particular for application of a deodorant to the underarms. This interval also allows the size of the device to be kept to an acceptable level.

Preferably, when the device is returned from the second configuration to the first, means are provided to force the application element towards the said second opening. Thus, any undesirable emergence via the second opening of the product remaining in the housing is limited or even prevented when the device is in the storage position.

Preferably, the application element form is elongated along said axis X, at least one of the ends terminating in part of a sphere, the centre of which is located on said axis X. This elongated form, as well as allowing a new aesthetic, contributes to increasing the application surface.

Preferably, the application element comprises a part of a sphere at each of its two ends. Thanks to this arrangement, during assembly the orientation of the application element relative to the housing, according to the axis of the latter, is indifferent.

In a further preferred manner, the application element is generally approximately ovoid in shape.

According to another advantageous characteristic of the invention, said first opening is in communication with a plunger tube, one end of which is immersed in the product, the container comprising at least one wall deformable elastically in response to a pressure exerted thereon. Thus the product can be supplied from the housing containing the application element at the same time as the application element engages with the surface to be treated, without having to turn the device to the upside down position. Handling is improved and use of products of higher viscosity is permitted.

Advantageously i) said means to bring said applicator structure from the first to the second configuration comprise a control element mobile in rotation in relation to the container and fixed axially in relation thereto;

ii) said control element has an edge delimiting said first opening; and iii) said control element is coupled relative to the support such that rotation of the control element in relation to the container causes an axial movement of the support from a first position, in which said spherical part co-operates with said edge so as to close in a sealed manner said first opening, to a second position in which said spherical part is remote from said edge so as to release at least part of said first opening.

Preferably, the device comprises a cover able to seal in a reversible manner said applicator structure. This cover prevents soiling of the environment in which the device is placed during storage, in particular a handbag, by the residual product which could remain on the part of the applicator surface opposite the said opening.

Means in particular in the form of a tab may be provided to drive said control element in rotation.

Advantageously, the container comprises a neck, a free edge of which delimits an opening on which is mounted the applicator structure, said axis X intercepting said opening.

Further advantageously, said neck is axially offset in relation to the container. This characteristic, in particular when axis X is inclined in relation to the axis of the container, allows the size of the device to be limited.

The device according to the invention can be used advantageously for the packaging and application of a cosmetic product, in particular a bodily hygiene product.

The invention consists, apart from the arrangements explained above, of a number of other arrangements which are explained below as non-limitative example embodiments described with reference to the attached drawings in which.

Figure 1:
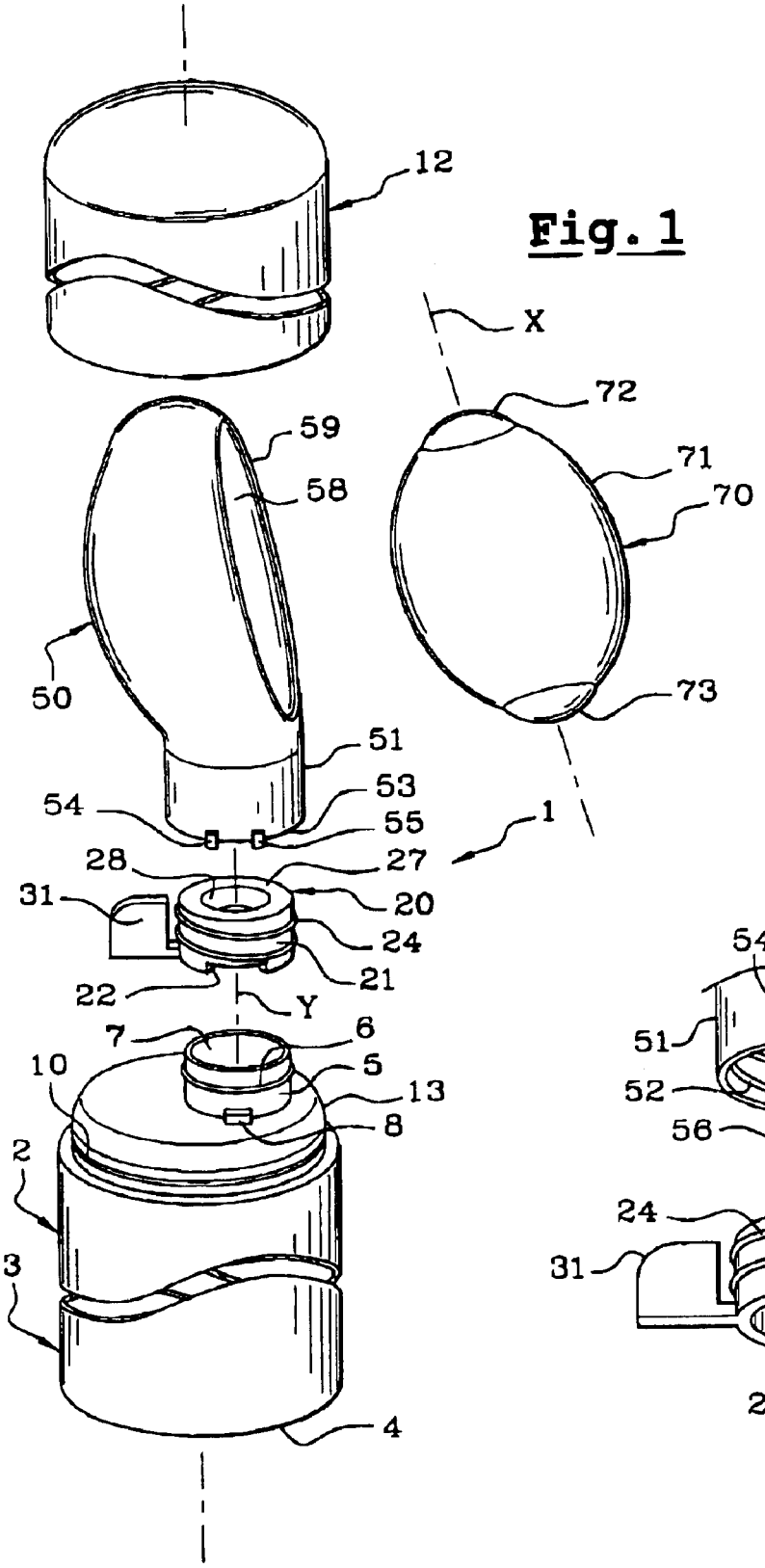
FIG. 1 shows an exploded perspective view of the device according to a preferred embodiment of the invention.
Figure 2:
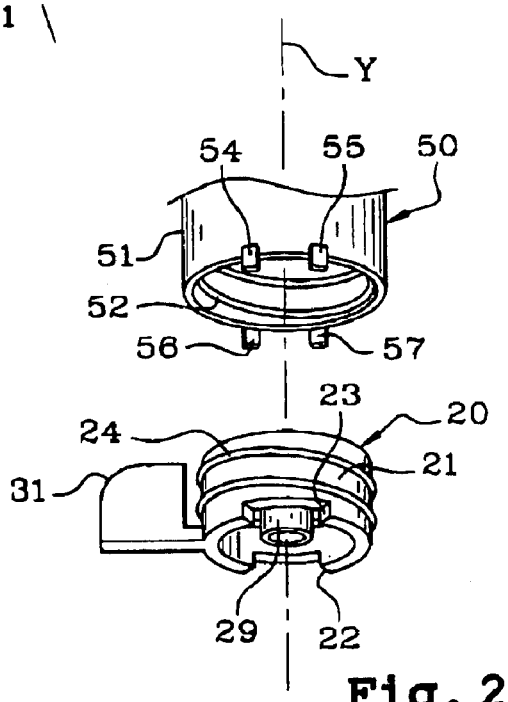
FIG. 2 shows an exploded perspective view of part of the device in FIG. 1 from a different angle.
Figure 3:
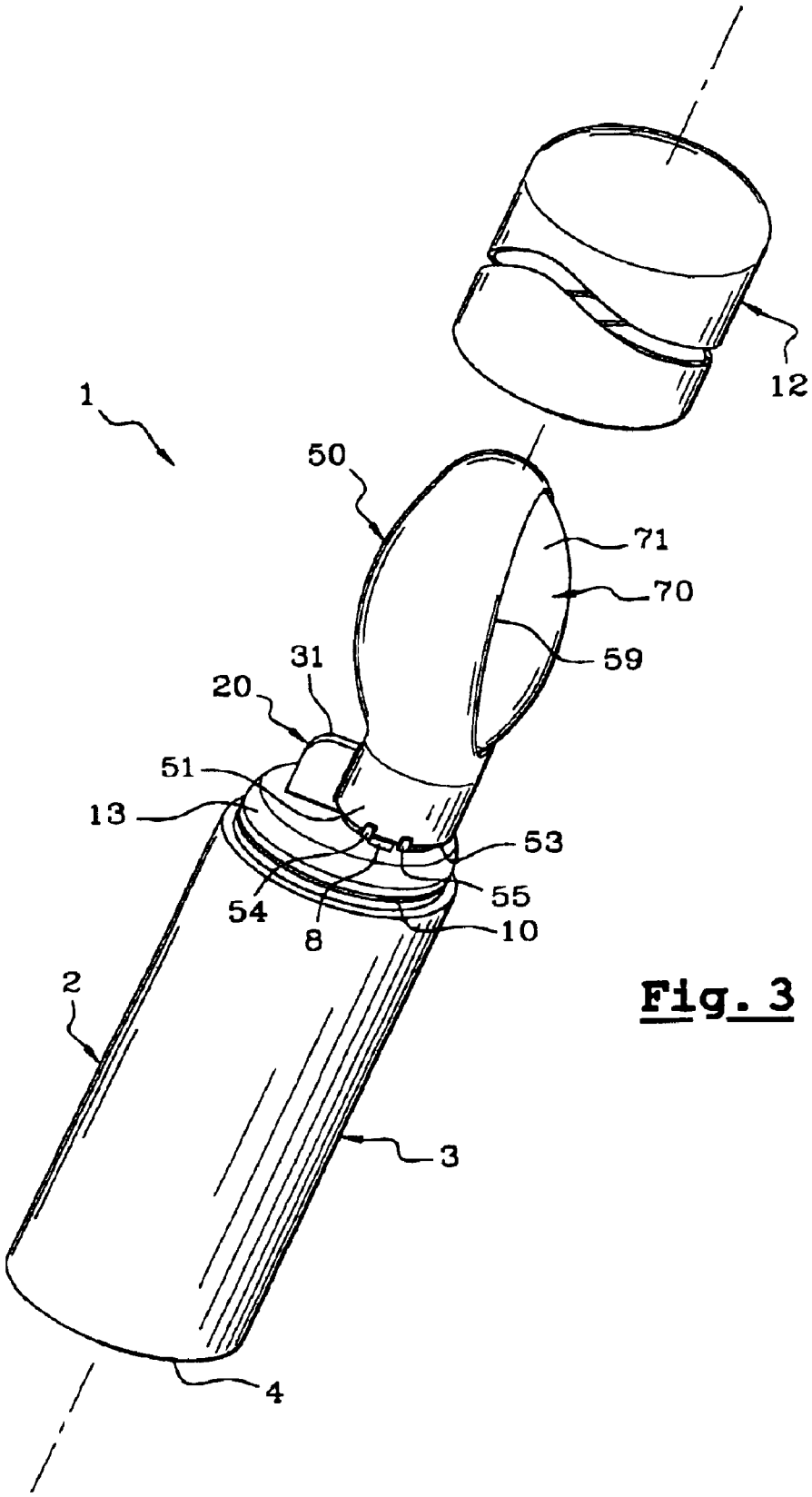
FIG. 3 shows a perspective view of the device in FIGS. 1 and 2 in the mounted position.

The device 1 shown on FIGS. 1 to 5, to which reference will now be made, comprises a container 2 with elastically deformable walls made by extrusion blow-moulding of polyethylene.

The container 2 comprises a cylindrical body 3, one end of which is closed by a base 4. The end of the container 2 opposite the base 4 comprises a neck 5 axially offset in relation to the longitudinal axis of the body 3, the external surface of which comprises an annular collar 6. A free end of the neck 5 delimits an opening 7 in a plane perpendicular to the longitudinal axis of the container.

On the outside of the neck 5, close to its base, are provided two diametrically opposed guide elements 8 extending approximate at angles of around 30°. The guide elements 8 extend axially to around one-third of the axial height of the neck 5. Their function will be discussed in more detail below.

On an external surface of the cylindrical body 3, close to its upper end, is provided an annular groove 10 able to co-operate by engagement with a corresponding collar 11 provided on the inner surface of a removable lid 12 close to its lower end. The annular groove 10 is provided on an annular part 13 radially slightly recessed in relation to the remainder of the cylindrical body 3, such that in the mounted position of the lid 12 on the container 2, the outer surface of the lid 12 is approximately aligned with the outer surface of the body 3 of container 2.

Figure 4:
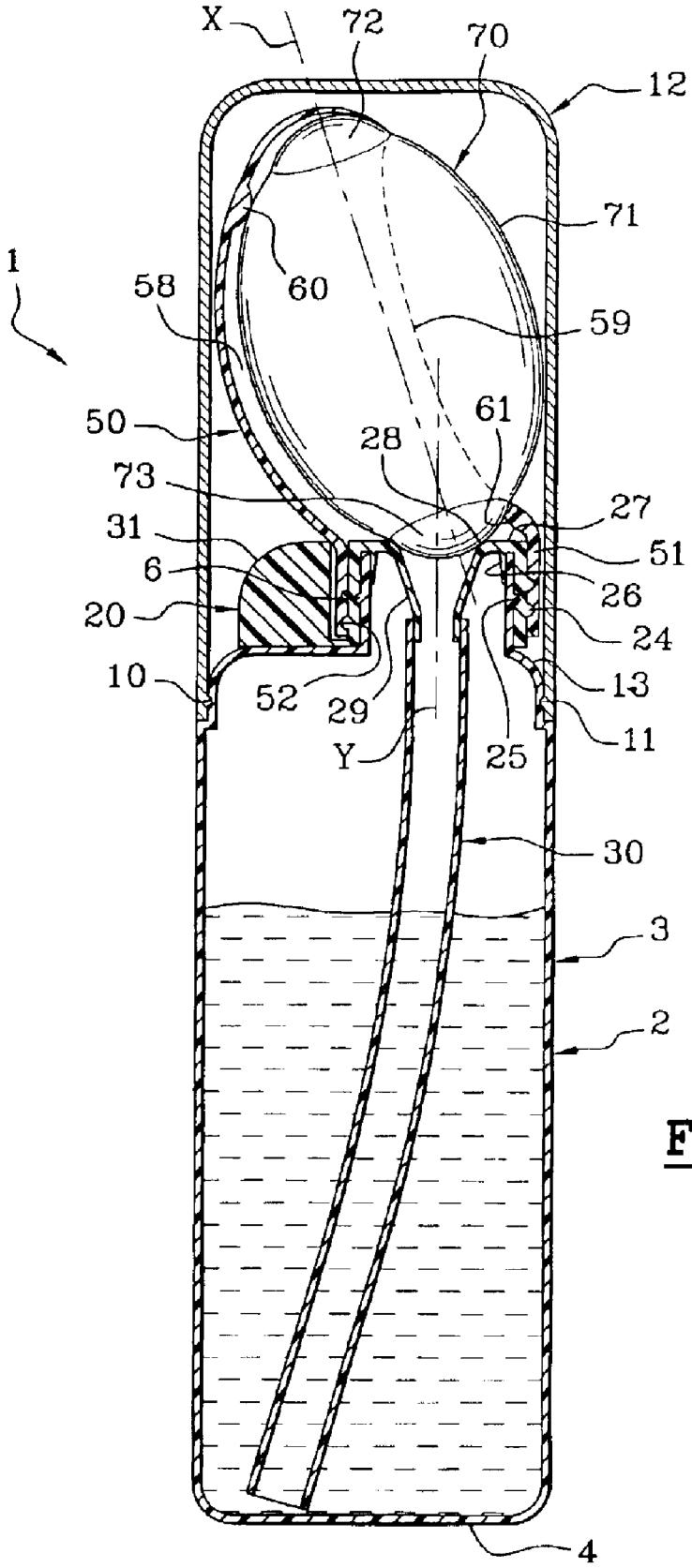
FIG. 4 is a cross-section view of the device in FIGS. 1 to 3 in the storage position.
Figure 5:
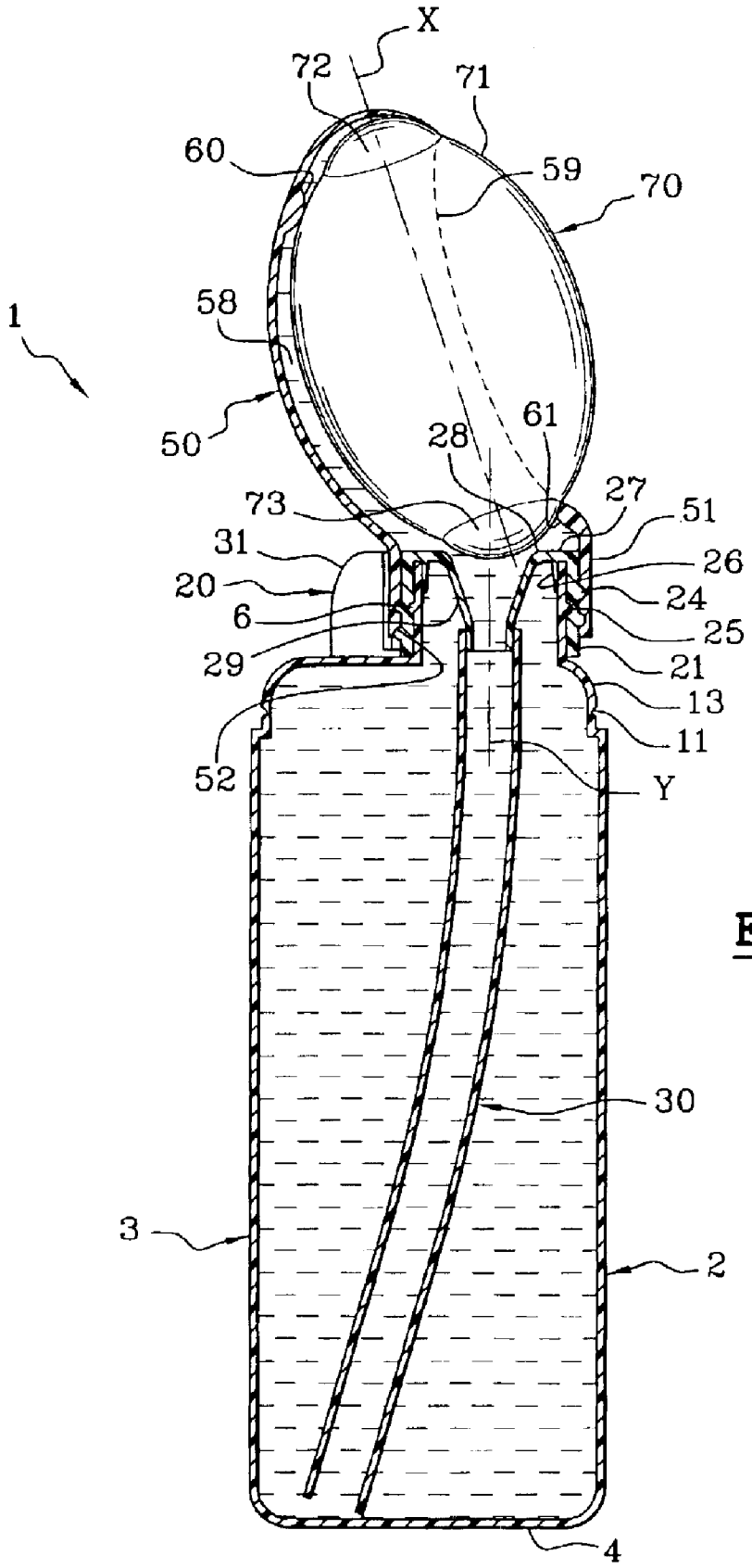
FIG. 5 is a cross-section view of the device in FIGS. 1 to 3 in the distribution position.

The device 1 also comprises an intermediate part 20 intended to form a control element able to transfer the device 1 from the storage position illustrated in FIG. 4 to the distribution position shown by FIG. 5.

The intermediate part 20 comprises an outer skirt 21 interrupted in its lower part by two diametrically opposed parts 22 and 23, the width of which corresponds to the desired travel between the storage position of the device (FIG. 4) and the distribution position (FIG. 5).

The outer surface of the outer skirt 21 has a thread 24.

The inner surface of the outer skirt 21 has an annular groove 25 able to cooperate by engagement with the annular collar 6 provided on the neck of the bottle 2 such that the intermediate part 20 freely rotates over an angular travel corresponding to the angular width of the interrupted skirt parts 22 and 23 and is immobile axially.

The intermediate part 20 also comprises a skirt 26 able to engage in a sealed manner inside the opening 7 delimited by the free edge of the neck 5 of the bottle 2.

The intermediate part 20 comprises a transverse annular wall 27 to which are connected the outer skirt 21 and the sealing skirt 26.

The transverse annular wall 27 terminates opposite the outer skirt 21 in an inner edge delimiting an opening 28 and is connected to an axial skirt 29, frustoconical in its part adjacent to the inner edge then cylindrical over a short portion and terminating in a free edge.

Over the cylindrical part of the axial skirt 29 is pushed by force-fit a plunger tube 30, a free end of which is located approximately at the base of container 2.

The intermediate part 20 also comprises a tab 31 extending radially and intended to allow the intermediate part 20 to be brought into rotation in relation to container 2.

The device 1 comprises an application element 70. This is of approximately ovoid shape and has a revolution surface 71 about an axis X. At each of its ends the application element terminates in part of a sphere 72, 73, the geometric centre of which is centred on the axis X.

Although the ovoid shape is a preferred form, other forms can also be considered, in particular cylindrical or conical with at least one hemispherical end, or a peanut shape.

The application element 70 is obtained by moulding a material such as polyethylene. Its application surface may have been the subject of various processes, in particular chemical, so as to modify the surface state with a view in particular to improving its capacity to transport the product before it is deposited on the surface to be treated.

The device 1 also comprises a support 50 intended to hold the application element 70. The support 50 comprises a cylindrical part 51, the inner surface of which has a thread 52 able to co-operate with the thread 24 provided on the outer surface of the skirt 21 of the intermediate part 20.

The outer surface of the cylindrical part 51 close to its free edge 53 comprises two pairs of stops 54, 55, 56, 57 intended to be positioned respectively on either side of the guide elements 8 provided on the neck 5 of the container. Thus rotation of the intermediate part 20 in relation to the container 2 causes an axial movement of the support 50 without its rotation.

Opposite the free edge 53, the skirt 51 is extended by a housing 58 of shape corresponding to the shape of the application element 70. The housing 58 comprises an opening 59 of elongated form oriented according to a mean direction inclined in relation to axis Y of neck 5 of the container 2. At the top, the opening 59 extends at a distance from the top of support 50 approximately equal to the height along axis X of the part of the sphere 72. At the bottom, the opening 59 extends approximately up the cylindrical part 51 of support 50.

Close to the lower part of the opening 59, the inner surface of the support 50 comprises a collar 61 intended to ensure axial coupling between the support 50 and the application element 70 when the support 50 is driven axially by the intermediate piece 20.

The application element 70 is dimensioned so it can be inserted in the housing 58 via its opening 59.

FIG. 4 to which reference is now made shows the device 1 in the mounted position in a configuration corresponding to the storage position.

In this position, the spherical part 73 rests in a sealed manner on the edge delimiting the opening 28 of the intermediate part 20, thus ensuring a seal to the product between the container 2 and the housing 58 defined by the support 50.

A collar 60 formed on the inner surface of the housing 58 close to the upper part holds the application element 70 at a distance from the inner surface of the housing 58 so as to form between the two a passage which, when the device is in the distribution configuration shown in FIG. 5, allows communication of the application surface 71 with the product.

Also, in the storage position of FIG. 4, the collar 60 forces the application element 70 in the direction of the opening 59 so as to prevent largely any flowing of the product remaining inside the housing 58 through the said opening 59.

Because of this constraint, in the storage position in FIG. 4 and also because of the forces applied to application element 70 approximately along its axis X, the rotation of the application element about its axis is made difficult or even impossible.

In this position, the angle formed between the axis X of the application element 70 and the mean plane containing the opening 28 of the intermediate part 20 is between 45° and 80° and preferably of the order of 60°.

The angle formed between the rotation axis X of the application element and axis Y corresponding to the axis of opening 28 is between 10° and 45° and preferably of the order of 25° to 30°.

To use the device according to the invention, the user, after having removed the lid 12, by means of the tab 31 rotates the intermediate part 20 in relation to container 2 over an angular travel corresponding to the angular width of the interrupted skirt parts 22 and 23, or around 20° to 30°.

So doing, and as appears clearly from FIG. 5, the support 50 is driven axially over a sufficient distance for the application element 70 coupled axially to support 50, via the collar 61 formed on the inner surface of support 50, to move away from the edge delimiting the opening 28 of the intermediate piece 20, thus creating a liquid communication between the container 2 and the housing 58 formed by the support 50.

Figure 6:
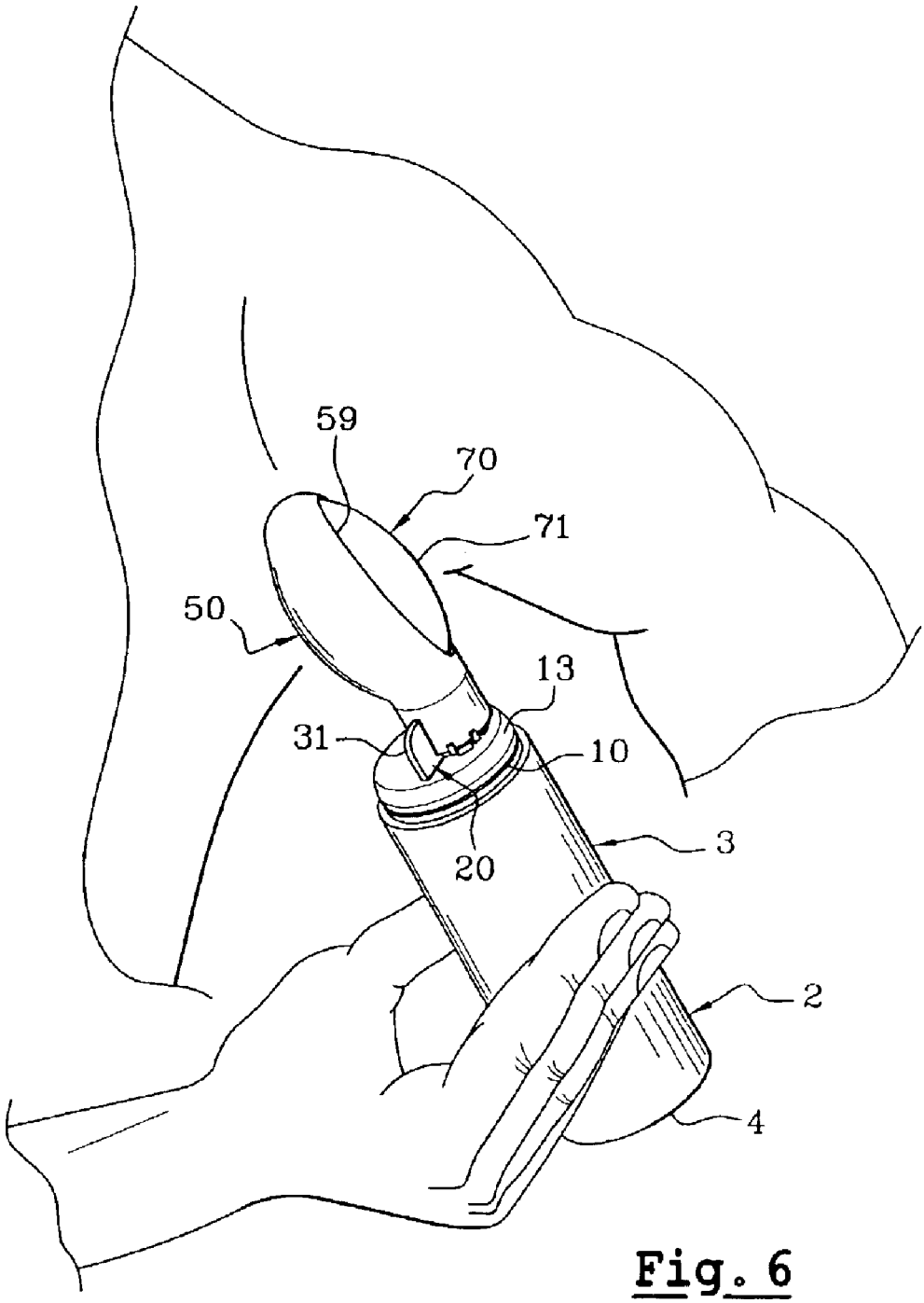
FIG. 6 illustrates the use of the device in FIGS. 1 to 5 for application of a bodily deodorant.

As shown on FIG. 6, the user presses on the flexible walls of the container 2 so as to create inside the latter sufficient positive pressure to cause the product to rise in the plunger tube and pass via the opening 28 into the space formed between the surface of the application element 70 and the inner surface of support 50, thus bringing the product into contact with the application surface.

Releasing the pressure on the flexible walls of container 2 causes the latter to return elastically to their non-deformed position. During this return, the air is drawn into the container 2 so as to re-establish in its interior a pressure approximately equal to atmospheric pressure.

In the conventional manner for a roll-on type applicator, the user places the part of the application surface 71 opposite the opening 59 onto the skin and moves it by friction in relation to the skin, causing said applicator to rotate about its revolution axis X, thus during passage depositing the product with which it is loaded.

As appears from the above, the product can be transferred to the application surface 71 simultaneously with the movement of the application surface over the skin with an action not requiring special contortions.

After use, the user rotates the tab 31 of the intermediate piece 20 in the opposite direction, thus displacing the support 50 and the application element 70 axially downwards until the spherical part 73 of the latter comes to rest tightly on the edge of the seal delimiting the opening 28. As stated above, during this axial movement downwards the application element 70 is forced in the direction of opening 59.

In the detailed description above, reference has been made to preferred embodiments of the invention. It is evident that variants may be made without leaving the spirit of the invention as claimed below.

What is claimed is:

1. A device for packaging and application of a product, in particular a cosmetic product, the device comprising a container containing the product and fitted with an applicator structure comprising:

i) a support delimiting a housing; and ii) a non-spherical application element arranged inside the housing, the surface of which rotates about at least one axis X;

wherein the applicator structure is adapted to move from a first configuration in which part of the application element closes in a sealed manner a first opening formed between the container and the housing, to a second configuration in which the housing communicates with the container via the first opening and in which the application element rotates freely about the axis X such that part of the surface of revolution, after coming into contact with the product, can be brought via a second opening delimited by the housing, into engagement with a surface onto which the product is to be applied, the movement between the first configuration and the second configuration occurring through translation of the applicator structure.

2. The device claimed in claim 1, wherein the sealing part is centred on axis X, and at least one section perpendicular to the plane of the first opening is of circular form.

3. The device claimed in claim 2, wherein the sealing part of the application element consists of a part of a sphere.

4. The device claimed in claim 2, wherein the axis X intercepts the plane of the first opening.

5. The device claimed in claim 4, wherein the axis X forms an angle between 45° and 80° with the plane.

6. The device claimed in claim 1, wherein the device further comprises means for, on return of the device from the second configuration to the first, forcing the application element towards the second opening.

7. The device claimed in claim 1, wherein the application element is of elongated form along the axis X, at least one of its ends terminating in part of a sphere, the centre of which is located on the axis X.

8. The device claimed in claim 7, wherein the application element comprises part of a sphere at each of its two ends.

9. The device claimed in claim 7, wherein the application element is an approximately ovoid shape.

10. The device claimed in claim 1, wherein the first opening communicates with a plunger tube, one end of which is immersed in the product, the container comprising at least one wall elastically deformable in response to a pressure exerted thereon.

11. The device claimed in claim 1, wherein said device further comprises a control element mobile in rotation in relation to the container and fixed axially in relation thereto; the control element having an edge delimiting the first opening; and the control element being coupled relative to the support such that rotation of the control element in relation to the container causes translational movement of the support from a first position, in which the sealing part of the applicator element co-operates with the edge so as to close in a sealed manner the first opening, to a second position in which the sealing part is remote from the edge so as to release at least part of the first opening.

12. The device claimed in claim 1, wherein the device further comprises a lid adapted to seal in a reversible manner the application element.

13. The device claimed in claim 11, wherein means in particular in the form of a tab are provided to drive the control element in rotation.

14. The device claimed in claim 1, wherein the container comprises a neck, one free edge of which delimits an opening and on which is mounted the applicator structure, the axis X intercepting said opening.

15. The device claimed in claim 14, wherein the neck is axially offset in relation to the container.

16. Device for packaging and application of a product, in particular a cosmetic product, the device comprising a container containing the product and fitted with an applicator structure comprising:

i) a support delimiting a housing;

ii) a non-spherical application element arranged inside the housing, the surface of which rotates about at least one axis X;

wherein the applicator comprises iii) means to adapt it from a first configuration in which part of the application element closes in a sealed manner a first opening formed between the container and the housing, to a second configuration in which the housing communicates with the container via said first opening and in which the application element rotates freely about said axis X such that part of the said surface of revolution, after coming into contact with the product, can be brought via a second opening delimited by the housing, into engagement with a surface onto which the product is to be applied, said sealing part being centred on axis X, and at least one section perpendicular to the plane of the first opening is of circular form.

17. Device according to claim 16, wherein said sealing part of the application element consists of a part of a sphere.

18. Device according to claim 17, wherein said axis X intercepts the plane of said first opening.

19. Device according to claim 18, wherein said axis X forms an angle between 45° and 80° with said plane.

20. Device according to claim 16, wherein it comprises means for, on return of device from the second configuration to the first, forcing the application element towards the said second opening.

21. Device according to claim 16, wherein the application element is of elongated form along said axis X, at least one of its ends terminating in part of a sphere, the centre of which is located on said axis X.

22. Device according to claim 21, wherein the application element comprises part of a sphere at each of its two ends.

23. Device according to claim 21, wherein the application element is an approximately ovoid shape.

24. Device according to claim 16, wherein said first opening communicates with a plunger tube, one end of which is immersed in the product, the container comprising at least one wall elastically deformable in response to a pressure exerted thereon.

25. Device according to claims 16, wherein:

i) said means to bring said applicator structure from the first to the second configuration comprises a control element mobile in rotation in relation to the container and fixed axially in relation thereto;

ii) said control element has an edge delimiting said first opening; and iii) said control element is coupled relative to the support such that rotation of the control element in relation to the container causes an axial movement of the support from a first position, in which said sealing part of the applicator element co-operates with said edge so as to close in a sealed manner said first opening, to a second position in which said sealing part is remote from said edge so as to release at least part of said first opening.

26. Device according to claim 25, wherein means in particular in the form of a tab are provided to drive said control element in rotation.

27. Device according to claim 16, wherein it comprises a lid able to seal in a reversible manner said applicator structure.

28. Device according to claim 16, wherein the container comprises a neck, one free edge of which delimits an opening and on which is mounted the applicator structure, said axis X intercepting said opening.

29. Device according to claim 28, wherein said neck is axially offset in relation to the container.

30. A device for storing and applying a liquid fluid, the device comprising:

a container for storing the liquid fluid;

a support structure extending from the container, the support structure forming a housing;

an applicator rotatably mounted within the housing;

a first opening permitting fluid communication between the container and the housing; and a second opening in said housing adapted to expose a portion of said application;

wherein the housing is adapted to move between a first position forcing the applicator against the first opening to seal the first opening and a second position forcing the applicator away from the first opening to reveal the first opening and allow fluid to pass therethrough.

31. The device claimed in claim 30, wherein the applicator is non-spherical and is adapted to rotate about an axis X, the axis X intercepting a plane containing the first opening.

32. The device claimed in claim 30, further comprising a plunger tube in fluid communication with the first opening and extending into the container storing the liquid fluid, wherein the liquid fluid may be brought toward the first opening through the plunger tube in response to a pressure exerted on the container.

33. A device for housing and applying a liquid product, said device comprising:

an applicator element, said applicator element having an axis x;

a housing partially surrounding said applicator element, said housing adapted to permit said applicator element to rotate about said axis x;

a container adapted to house a liquid product, said container having a first opening in fluid communication with said housing;

wherein said housing has a first position in which said housing moves said applicator element against said first opening to seal said first opening and a second position in which said housing moves said applicator element away from said first opening to permit liquid product to flow therefrom.

34. The device claimed in claim 33 wherein the application element is non-cylindrical.

35. The device claimed in claim 33, wherein the axis x intercepts a plane containing the first opening.

36. The device of claim 33, further comprising a plunger tube extending into the container from the first opening, wherein the liquid fluid may be brought toward the first opening through the plunger tube upon pressure exerted on the container.

37. The device of claim 33, wherein said liquid product is a cosmetic product.

38. The device of claim 33, wherein said applicator element further comprises a first end and a second end, said housing adapted to engage said first end and said second end of said application element.

39. The device of claim 38, wherein said housing further comprises a second opening, said second opening spanning partially between said first end and said second end of said applicator element to expose said application element.

40. The device of claim 39, further comprising a lid adapted to cover said second opening.

41. The device of claim 38, wherein said first end of said applicator element seals against said first opening in said first position of said housing.

42. The device of claim 38, wherein said first and said second end of said applicator element are hemispherical.

43. The device of claim 33, wherein a portion of said applicator element extends into said first opening in said first position of said housing.

* * * * *